US011406150B1

(12) United States Patent
Tessler

(10) Patent No.: US 11,406,150 B1
(45) Date of Patent: Aug. 9, 2022

(54) WEIGHTED GARMENT TABS

(71) Applicant: Jillian Tessler, New York, NY (US)

(72) Inventor: Jillian Tessler, New York, NY (US)

( * ) Notice: Subject to any disclaimer, the term of this patent is extended or adjusted under 35 U.S.C. 154(b) by 682 days.

(21) Appl. No.: 16/212,985

(22) Filed: Dec. 7, 2018

(51) Int. Cl.
*A41F 17/00* (2006.01)

(52) U.S. Cl.
CPC ..... *A41F 17/00* (2013.01)

(58) Field of Classification Search
CPC ..... A41F 17/00
See application file for complete search history.

(56) References Cited

U.S. PATENT DOCUMENTS 268,769 A * 12/1882 Brooks ..... A41F 17/00 2/273
269,154 A * 12/1882 Brooks ..... A41F 17/00 2/273
614,189 A * 11/1898 Waitzfelder ..... A41F 17/00 2/273
970,175 A * 9/1910 Brooks ..... A41F 17/00 2/273
1,084,233 A * 1/1914 Roarke ..... A41F 17/00 2/273
1,098,678 A * 6/1914 Morley ..... A41F 17/00 2/273
1,099,931 A * 6/1914 Paull ..... A41F 17/00 2/273
1,388,802 A * 8/1921 Cooper ..... A41F 17/00 2/273
3,107,361 A * 10/1963 Glutting, Sr. ..... A47K 3/38 4/558
3,237,261 A * 3/1966 Homonoff ..... A47H 23/01 160/349.1
3,531,835 A * 10/1970 Paikin ..... A41F 1/00 24/516
3,947,896 A * 4/1976 Taylor ..... A41F 17/00 2/217
4,139,912 A * 2/1979 Thuaud ..... A45D 44/08 2/50
4,723,326 A * 2/1988 Tarlow ..... A47K 3/38 160/349.1
5,517,722 A * 5/1996 Bender ..... A47H 19/00 16/87.2

(Continued)

OTHER PUBLICATIONS

Dress Downs, The First Dress Weights, "Designed to keep your dress down and head high when the wind blows," retrieved from the Internet Dec. 3, 2018, 3 pgs.; https://www.garmentweight.com/.

(Continued)

*Primary Examiner* — Richale L Quinn
(74) *Attorney, Agent, or Firm* — Allan A. Fanucci

(57) ABSTRACT

A weighted garment tab in the form of a weighted disk that has a fabric-safe and reusable adhesive on the back surface. The adhesive generally includes a cover or release member that protects it before application to the garment. This tab has a smooth, hard finish that does not catch onto or snag onto the dress fabric and is smaller, flatter, and smoother compared to the prior art devices mentioned above, so that it is much less noticeable to the wearer during use. Also, a method of preventing upward movement of a garment in an air current by applying one or more tabs onto the hem or lower portion of the inside of the garment.

20 Claims, 2 Drawing Sheets

(56) References Cited

U.S. PATENT DOCUMENTS 5,785,181 A 7/1998 Quartararo, Jr.
6,458,440 B1 * 10/2002 Merritt ..... B65D 57/004 428/40.1
D490,216 S * 5/2004 Powell ..... D18/27
7,503,079 B1 * 3/2009 Fletcher ..... A42B 5/00 2/207
7,900,277 B1 * 3/2011 O'Brien ..... A41F 17/00 2/273
8,153,221 B1 * 4/2012 MacKinnon ..... A41F 1/00 428/40.1
8,370,964 B1 2/2013 Kaper
8,393,015 B2 * 3/2013 Jones ..... A41F 17/02 2/273
8,695,193 B2 * 4/2014 Kress ..... A47H 99/00 29/414
8,695,194 B2 * 4/2014 Kress ..... A47H 23/00 29/414
9,351,528 B2 * 5/2016 Grimes ..... A41F 17/02
2008/0189831 A1 * 8/2008 Jones ..... A41F 17/02 2/273
2011/0117317 A1 * 5/2011 Kress ..... A47H 23/00 428/122
2012/0011637 A1 * 1/2012 Fries ..... H01F 7/0263 2/243.1
2012/0137412 A1 * 6/2012 Jones ..... A41F 17/02 2/273
2013/0104291 A1 * 5/2013 Daniel ..... A41F 17/00 2/273
2014/0352031 A1 * 12/2014 Choi ..... A42B 1/04 2/173
2016/0174643 A1 * 6/2016 Miller ..... A41F 19/00 428/42.2
2017/0079353 A1 * 3/2017 Mann ..... A41F 17/00
2018/0055120 A1 * 3/2018 Gall-Krasnick ..... A41F 17/00
2019/0191802 A1 * 6/2019 Dunn ..... A41F 17/02
2019/0364999 A1 * 12/2019 Baschak ..... A41D 1/089
2020/0224067 A1 * 7/2020 Von Wedel-Parlow ..... C09J 123/16
2020/0359725 A1 * 11/2020 Harrington ..... A41D 27/08

OTHER PUBLICATIONS

Dress Weights by DressStrong, "A Windy Day Fashion Fix," retrieved from the Internet Dec. 3, 2018, 3 pgs; https://www.dressstrong.com/.

* cited by examiner

WEIGHTED GARMENT TABS

BACKGROUND

The present invention is a weighted garment tab for use primarily on dresses, skirts, and tops to prevent updrafts from moving the hem of the dress, skirt, or top upwards, sideways or into any other incorrect position. One or more weighted garment tabs applied to the hem of a dress, skirt, or top will provide sufficient additional resistance to such movements of the garment. Also, the tabs have an adhesive that has sufficient adhesiveness to stick to most fabrics including silk while also being removable to be re-positioned on one garment or to be removed and used on a different garment or clothing item.

A particular issue when wearing a skirt, dress, or top on a windy day is that it sometimes can become a struggle to keep the lower portion and hem in position to prevent them from moving upwards along with air currents. Even an isolated breeze or wind gust can cause the hem of these garments to move upward and cause embarrassment for the wearer. Accordingly, there is a need for a device that can provide resistance to such upward movements of these garments.

This is not a new problem, and the prior art has addressed it in the past with various potential solutions. It is known to pin a weight to a dress hem (US 2013/0104291), but this requires making a hole in the garment. To avoid damaging the garment, US 2012/0011637 utilizes a pair of magnets for holding a weight onto the hem of a dress, skirt, blouse or other article of clothing. The magnetic part that is placed on the outside of the dress is of course visible to others thus detracting from the appearance of the garment. Another solution to avoid damaging the garment is to use a clip to attach a weight (U.S Pat. No. 9,351,528), but the device of this patent is bulky and also is visible on the outer side of the hem. U.S Pat. No. 8,393,015 provides a clip that is attached to the inside of the dress but this again is bulky and includes a hanging weight that move to contact the wearer's leg when walking. It is also known to sew weights into the hem of a slip (U.S Pat. No. 7,900,277) but such weights are not removable and can cause issues when the garment is laundered.

More recently, there are certain commercially available hem weights that are secured to the inside hem of a dress or skirt by an adhesive (see dressdowns.com and garment-weights.com). These devices are also thick and bulky and provide an uncomfortable clunky feeling against the wearer's legs when walking.

Thus, there still remains a need for a less conspicuous, less obtrusive, and versatile garment weight and this is now provided by the present invention.

SUMMARY OF THE INVENTION

Now, therefore, the present invention provides a weighted garment tab that is essentially a weighted disk that has a fabric-safe and reusable adhesive on the back surface. The adhesive generally includes a release layer or backing member that protects it before application to the garment. This tab has a smooth, hard finish that does not catch onto or snag onto the fabric of the garment and is smaller, flatter, and smoother compared to the prior art devices mentioned above, so that it is much less noticeable to the wearer or others during use.

The disk can be provided in any pantone color. While black, grey or white are often used due to their universal nature, the disk color can be selected to match the color of the garment to which it is to be applied. Also, multiple disks will be applied, preferably four or more if desired, positioned and spaced around the hem on the inside of the garment so that they are hidden.

The invention also provides a method of minimizing or eliminating a garment from lifting due to air movement which comprises attaching one or more weighted garment tabs as disclosed herein to a lower portion of the garment so that the weight of the tab(s) provide resistance to upward movement of the garment.

BRIEF DESCRIPTION OF THE DRAWINGS

Various features of examples and embodiments in accordance with the principles described herein may be more readily understood with reference to the following detailed description taken in conjunction with the accompanying drawings, where like reference numerals designate like structural elements, and in which.

DETAILED DESCRIPTION OF THE INVENTION

Figure 1:
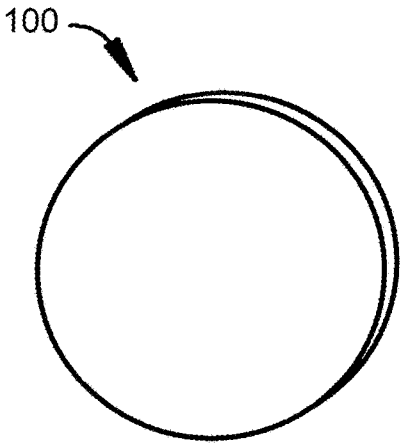
FIG. 1 is a front view of a weighted garment tab in accordance with the present invention.

The weighted garment tabs and method of use thereof according to the present invention represent a significant improvement to what is known in the art. First of all, the weighted garment tabs are configured to be relatively compact, thin, and smooth so that they do not cause any damage went contacting or sliding upon the garment fabric. Also, the adhesive that is used is capable of universal attachment to any type of fabric in a secure yet removable and fabric-safe manner. The compact nature of the device allows it to be worn both inconspicuously from view as well as in a manner that does not interfere with the wearer when walking. For a dress or skirt, the tabs keep the hem down and in position, while for a blouse or shirt, the tabs keep the top in place so that the hem of a top does not move around during walking or other movements. They also help resist a flowy top from moving upwards or sideways.

In particular, the weighted garment tab of the present invention consists of: a circular, solid steel disk having front and back surfaces, a diameter of between 25 and 40 mm, a peripheral edge, a thickness of between 2 and 2.5 mm and a weight of between 13 and 16 grams; a coating of a rubberized paint uniformly covering the edges and both surfaces of the disk, the rubberized paint providing a smooth and hard low friction surface; a reusable fabric adhesive applied onto one surface of the disk and covering an area of 50 to 93.75% of that surface of the disk; and an optional but preferred release layer or backing member covering the adhesive. The disk has a preferred diameter of between 32 and 38 mm, a preferred thickness of between 2.1 and 2.3 mm and a preferred weight of between 14.5 and 15.5 grams. The adhesive preferably has a diameter of between 25 and 30 mm and covers 65.79 to 93.75% and preferably 77.31 to 78.94% of the surface of the disk. Thus, the peripheral portion has an area of 6.25 to 34.21% of the first surface of the disk.

Turning now to the drawings, FIG. 1 illustrates the front surface of weighted garment tab 100. As noted herein, this tab has relatively flat and smooth surfaces by virtue of the coating that is applied to the underlying steel disk. The front surface is smooth and if desired could include a product name or other advertising information.

Figure 2:
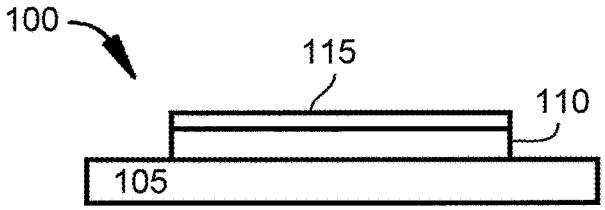
FIG. 2 is a side view of the weighted garment tab of FIG. 1.

Although not shown to exact dimensions, FIG. 2 illustrates a side view of the device to illustrate the disk thickness 105, the location of the adhesive layer 110 and the location of the optional release layer or backing member 115. The backing member can be substituted by a support structure as disclosed hereinbelow.

Figure 3:
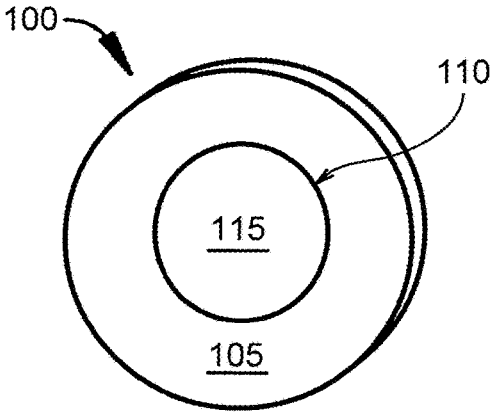
FIG. 3 is a back view of the weighted garment tab of FIG. 1.

FIG. 3 illustrates the location of the adhesive and backing member on the back surface of the disk. The adhesive is provided in a generally central location although it can be placed anywhere on the back surface of the tab 100. Typically, the adhesive is placed in the center of the disk and is a circular spot having a diameter of between 25 and 30 mm.

Figure 4:
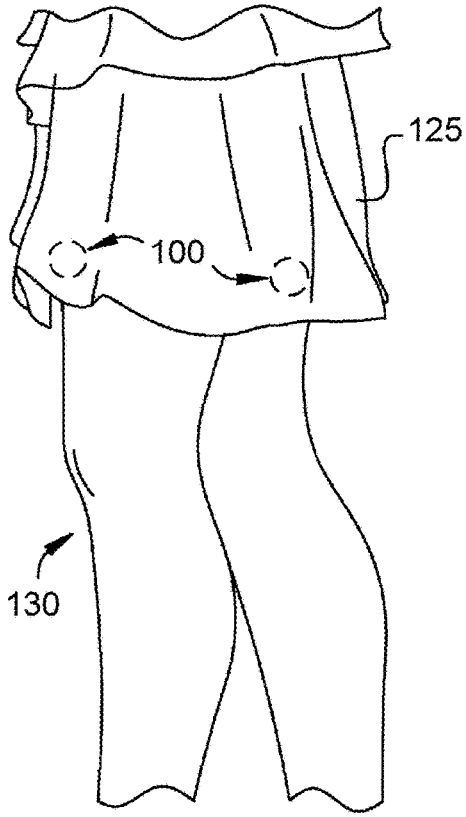
FIG. 4 is a view of a dress hem that includes a plurality of weighted garment tabs attached thereto.

FIG. 4 illustrates a garment in the form of a dress 125 that includes two weighted garment tabs 100 secured to the inside of the dress hem. The tabs provide resistance to upward movement of the dress hem away from the wearer's legs 130. Any desired number of tabs can be used depending upon the garment fabric and weight. The lighter fabrics would generally use more to assure sufficient resistance against upward movement.

The details of a most preferred embodiment of the invention includes the following:

material of disk: a thin and flat carbon steel size of disk: 34.925 mm (1.375 inches) in diameter by 2.2 mm in thickness weight: 14.5 grams (+/−5% tolerance)

adhesive material: 3M 9495 LSE available from 3M: this is a double sided polyester (polyethylene terephthalate) tape that has layers of an adhesive that sticks to plastic and rubber coatings as well as to most fabrics. The adhesive is reusable and fabric-safe. In particular, it is safe on silk garments.

the size of the adhesive is 27 mm in diameter and it is placed in the center of the back surface of the disk. It covers 77.31% of the surface of the disk and the adhesive-free peripheral portion has an area of 22.69%.

the disk has a coating of rubberized paint to provide a hard, smooth coating.

the rubberized paint can be of any particular color, as desired.

Both surfaces of the disk are flat as is the peripheral edge. The corners between the surfaces and edge are preferably slightly rounded for greatest smoothness. The back of the disk receives a fabric-safe adhesive and if desired for individual sale, a release layer or backing member (generally of paper or a plastic film) which protects the adhesive until the tab is to be applied to a garment hem. At that time, the backing member is removed and the disk is applied to the back of the hem on the inside of the dress so that it is not visible when being used.

Figure 5:
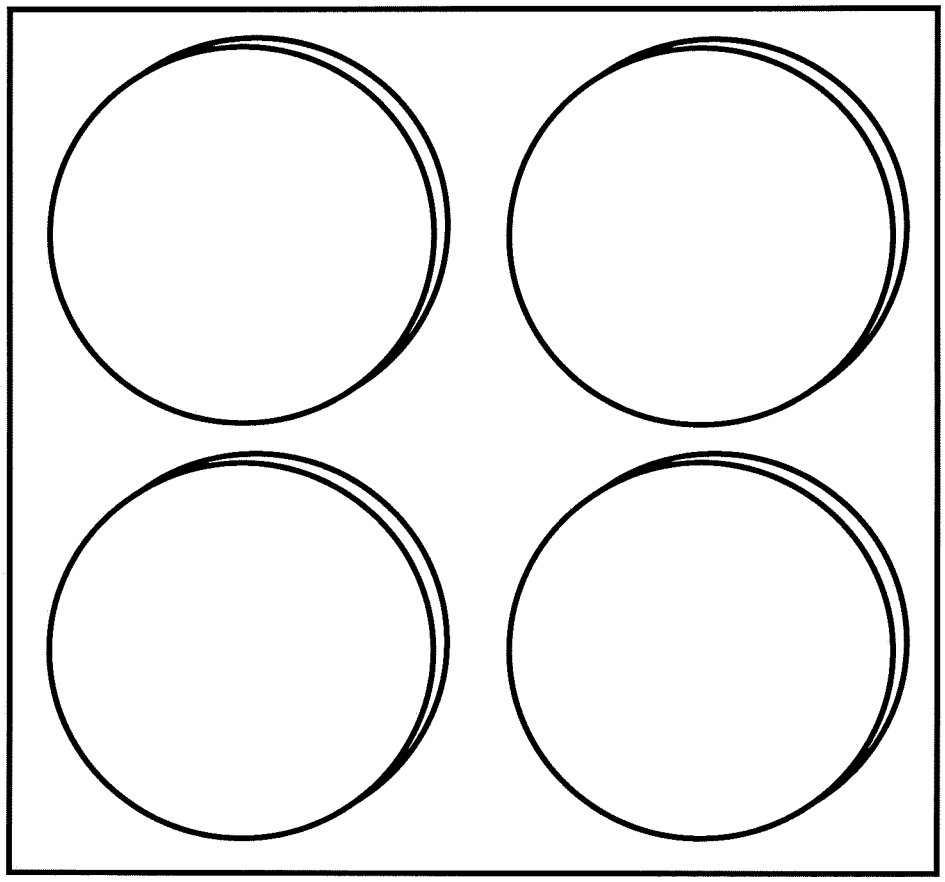
FIG. 5 is a perspective view of a package for holding multiple garment tabs.

Alternatively, when a plurality of tabs is to be sold together, these can be mounted on a plastic or treated cardboard sheet with the tabs arranged in an array and adhered to the sheet. The plastic sheet or treated cardboard sheet holds the tabs but allows their easy removal when the tabs are to be applied to a garment. An array of tabs, e.g., 2 by 2, 4 by 4, 4 by 8, 6 by 6 etc., on the sheet provides greater numbers of tabs for use on one or more garments while also providing a convenient support for storage and adhesive maintenance of unused tabs. A 2 by 2 array of tabs on a PVC plastic sheet is illustrated in FIG. 5.

The weighted garment tab can be used on any type of garment but preferably would be used on a dress, skirt, blouse or shirt. A number of these tabs could be applied as need with at least four generally being sufficient. If desired, up to 12 tabs can be used on lighter fabrics.

The fabric-safe adhesive is one that provides good strength and attachment to various fabrics (including silk) but is removable when the dress garment is to be washed or dry cleaned. The preferred adhesive is reusable and can be attached to and removed from silk fabric without damaging the fabric. This renders the invention more versatile that it is expected to work well on any type of fabric. This adhesive is also useful to allow the tabs to be removed from one garment to another if desired.

It should be understood that combinations of described features or steps are contemplated even if they are not described directly together or not in the same context.

It should also be understood that claims that include fewer recitations, claims without requiring a certain feature or process step in the appended claim or in the specification, clarifications to the claim elements, different combinations, and alternative implementations based on the specification, or different uses, are also contemplated by the embodiments of the present invention.

Terms or words that are used herein, including those that have been provided with specific definitions, are directed to those of ordinary skill in the art in this field of technology and the meaning of those terms or words will be understood from terminology used in the field or that can be reasonably interpreted based on the plain English meaning of the words in conjunction with knowledge in this field of technology. This includes an understanding of implicit features that for example may involve multiple possibilities, but to a person of ordinary skill in the art a reasonable or primary understanding or meaning is understood.

Finally, it should be understood that the above-described embodiments are merely illustrative of some of the many specific examples that represent the principles described herein. Clearly, those skilled in the art can readily devise numerous other arrangements without departing from the scope of the invention as defined by the following claims.

What is claimed is:

1. A weighted garment tab consisting of:

a circular, solid steel disk having front and back first and second surfaces, a diameter between 32 and 38 mm, a peripheral edge, a first rounded corner between the first surface and the peripheral edge, a second rounded corner between the second surface and the peripheral edge, a thickness of between 2 and 2.5 mm and a weight of between 13 and 16 grams;

a coating of a rubberized paint uniformly covering the peripheral edge, first and second corners, and both first and second surfaces of the disk, the rubberized paint providing a smooth and hard low friction surface; and a reusable fabric-safe adhesive present in a central portion of the first surface of the disk and covering an area of 65.79 to 93.75% of the first surface of the disk, with the first surface having a peripheral portion adjacent the rounded corner and extending to the adhesive, the peripheral portion having an area of 6.25 to 34.21% of the first surface of the disk and being free of adhesive to assist in removal of the weighted garment tab from the fabric when desired; and an optional release layer covering the adhesive.

2. The weighted garment tab of claim 1 wherein:
the disk has a thickness between 2.1 and 2.3 mm and a weight of between 13.5 and 15.5 grams; and
the adhesive covers 77.31 to 78.94% of the first surface of the disk.

3. The weighted garment tab of claim 1 wherein:
the disk has a thickness between 2.1 and 2.3 mm and a weight of between 13.5 and 15.5 grams; and
the adhesive is a circular spot having a diameter of 25-30 mm.

4. The weighted garment tab of claim 1 wherein:
the disk has a diameter of 34.925 mm, a thickness of 2.2 mm and a weight of about 14.5 grams; and
the adhesive is a circular spot having a diameter of 27 mm.

5. The weighted garment tab of claim 1 wherein the adhesive is a dual sided polyester tape having sufficient adhesiveness to removably stick to plastic, rubber and most fabrics including silk.

6. The weighted garment tab of claim 1 wherein the adhesive is a dual sided polyethylene terephthalate tape having sufficient adhesiveness to removably stick to plastic, rubber and most fabrics including silk.

7. The weighted garment tab of claim 1 wherein the release layer is present to cover the adhesive and prevent sticking until the tab is to be applied to a garment.

8. A package of weighted garment tabs that includes a plurality of garment tabs according to claim 1 arranged on and adhered to a plastic or treated paper sheet.

9. The package of claim 8 wherein between 4 and 12 garment tabs are arranged on and adhered to the plastic sheet.

10. A method of minimizing or eliminating a garment from lifting or moving due to air currents which comprises attaching one or more weighted garment tabs according to claim 1 to a lower portion of the garment so that the weight of the tab(s) provide resistance to upwards or sideways movement of the garment.

11. The method of claim 10 wherein the garment is a dress, skirt, shirt or blouse and the tab(s) are attached to a location or locations on an inner side of the garment.

12. The method of claim 10 wherein at least four tabs are applied with the tabs being reusable and removable to be repositioned in a different location on the garment for greatest effectiveness in revisiting upward, sideways, or incorrect movement of the garment.

13. The method of claim 10 wherein the release layer is present on each of garment tab(s) but is removed prior to applying the tab(s) to the garment.

14. The method of claim 10 further comprising providing a plurality of garment tabs in a package.

15. The method of claim 14, wherein between 4 and 12 garment tabs are present in the package.

16. A package of weighted garment tabs that includes a plurality of garment tabs according to claim 1.

17. The package of claim 16, wherein between 4 and 12 garment tabs are present in the package.

18. A weighted garment tab comprising:
a circular disk having first and second surfaces, a diameter between 32 and 38 mm, a peripheral edge, a first rounded corner between the first surface and the peripheral edge, a second rounded corner between the second surface and the peripheral edge, a thickness of between 2 and 2.5 mm and a weight of between 13 and 16 grams;
a smooth and hard coating uniformly covering the peripheral edge, first and second corners, and first and second surfaces of the disk; and
a reusable fabric-safe adhesive present in a central portion of the first surface of the disk and covering an area of 65.79 to 93.75% of the first surface of the disk, with the first surface having a peripheral portion adjacent the rounded corner and extending to the adhesive, the peripheral portion having an area of 6.25 to 34.21% of the first surface of the disk and being free of adhesive to assist in removal of the weighted garment tab from the fabric when desired.

19. The weighted garment tab of claim 18, wherein the adhesive is a circular spot having a diameter of 25-30 mm, and further comprising a release layer which is present to cover the adhesive and prevent sticking until the tab is to be applied to a garment.

20. The weighted garment tab of claim 18, wherein the coating comprises a rubberized paint and wherein one or more weighted garment tabs are arranged on and adhered to a plastic or treated paper sheet.

* * * * *